US006740223B2

(12) United States Patent
Lipsztajn et al.

(10) Patent No.: US 6,740,223 B2
(45) Date of Patent: May 25, 2004

(54) ELECTROLYTIC PROCESS FOR THE PRODUCTION OF CHLORINE DIOXIDE

(75) Inventors: Marek Lipsztajn, Etoticoke (CA); Ronald K. Schaible, Mississauga (CA); Yuri Alexeevich Omelchenko, Toronto (CA); George Joseph Ranger, Mississauga (CA)

(73) Assignee: Superior Plus Inc., Calgary (CA)

( * ) Notice: Subject to any disclaimer, the term of this patent is extended or adjusted under 35 U.S.C. 154(b) by 0 days.

(21) Appl. No.: 10/173,602

(22) Filed: Jun. 19, 2002

(65) Prior Publication Data

US 2003/0000848 A1 Jan. 2, 2003

Related U.S. Application Data

(60) Provisional application No. 60/299,772, filed on Jun. 22, 2001.

(51) Int. Cl.[7] ..... C25B 1/26
(52) U.S. Cl. ..... 205/499; 205/556
(58) Field of Search ..... 205/556, 499

(56) References Cited

U.S. PATENT DOCUMENTS

| | | | | |
|---|---|---|---|---|
| 2,163,793 A | | 6/1939 | Logan | |
| 2,717,237 A | | 9/1955 | Rempel | |
| 4,542,008 A | | 9/1985 | Capuano | |
| 5,106,465 A | | 4/1992 | Kaczur | |
| 6,203,688 B1 | | 3/2001 | Lipsztajn | |
| 6,306,281 B1 | * | 10/2001 | Kelley | 205/499 |

FOREIGN PATENT DOCUMENTS

| | | | |
|---|---|---|---|
| JP | 56-158883 | | 12/1981 |
| JP | 81-158883 | | 12/1981 |
| WO | WO 91/091158 | | 6/1991 |
| WO | WO 91/09990 | * | 7/1991 |
| WO | WO 94/26670 | | 11/1994 |

* cited by examiner

*Primary Examiner*—Arun S. Phasge
(74) *Attorney, Agent, or Firm*—Sim & McBurney

(57) ABSTRACT

Chlorine dioxide is produced at high conversion rates from aqueous sodium chlorite solution by electrochemical oxidation in an undivided electrochemical cell. The cell utilizes an anode of high surface area through which the aqueous sodium chlorite solution flows into an interelectrode gap between the anode and a cathode. Water or acidified water is fed into the interelectrode gap to function as catholyte and also to dilute the electrolyzed sodium chlorite solution to provide an aqueous solution of chlorine dioxide exiting from the electrochemical cell.

14 Claims, 3 Drawing Sheets

ELECTROLYTIC PROCESS FOR THE PRODUCTION OF CHLORINE DIOXIDE

FIELD OF THE INVENTION

The present invention is concerned with the electrolytic production of chlorine dioxide from chlorite ions. More particularly, the present invention relates to an electrochemical process and an electrolytic cell structure used to manufacture a high purity aqueous chlorine dioxide solution from a dilute aqueous alkali metal chlorite solution.

BACKGROUND TO THE INVENTION

It is known to produce chlorine dioxide electrolytically by electro-oxidation of chlorite ions according to the following reaction:

$$ClO_2^- \Longrightarrow ClO_2 + e^- \quad [1]$$

U.S. Pat. No. 2,163,793 describes an electrochemical chlorine dioxide generating process in which an aqueous solution of alkali metal chlorite and alkali metal chloride is electrolyzed in an electrolytic cell equipped with a porous diaphragm separating the anode and the cathode compartments.

Similar divided electrochemical cells equipped with various types of separators were also employed in numerous other patented processes for electro-oxidation of chlorite ions to chlorine dioxide.

For example, U.S. Pat. No. 2,717,237 discloses a method for producing chlorine dioxide by electrolysis of chlorite in the presence of water-soluble alkali metal sulfate, for example, sodium sulfate.

Japanese Patent Publication 56-158883 published Dec. 7, 1981, (U.S. Pat. No. 4,432,856) describes an electrolytic process for producing chlorine dioxide by oxidation of chlorite in which the electrolyzed solution, at a pH of 2 or less, is fed to a stripping tank where air is introduced to recover the chlorine dioxide.

U.S. Pat. No. 4,542,008 describes an electrolytic process for chlorine dioxide production in which the sodium chlorite concentration of the solution leaving the anode compartment is monitored by means of a spectrophotometric measurement.

Published PCT International Patent Application No. WO 91/09158 and the corresponding U.S. Pat. No. 5,106,465 disclose a method of producing chlorine dioxide from alkali metal chlorite in an ion-exchange compartment of a multi-compartment cell in which hydrogen ions generated in the anode compartment enter the ion-exchange compartment through a cation-exchange membrane, causing chlorite ion disproportionation resulting in the formation of chlorine dioxide.

PCT Published International Patent Application No. WO 94/26670 discloses a method of producing chlorine dioxide from sodium chlorite in which the gaseous product along with water vapor is removed from the electrolyzed solution by means of a microporous, hydrophobic gas membrane.

By removing water at the rate of its input to the anolyte, a continuous, environmentally innocuous operation with no undesired effluent can be effected.

While all the above mentioned patents and patent applications require the recirculation of the electrolyzed solution, PCT Published International Patent Application No. WO 91/09990 and related U.S. patents (U.S. Pat. Nos. 5,041,196; 5,084,149; 5,158,658; 5,298,280 and 5,294,319) teach an electrochemical process for producing chlorine dioxide from a dilute alkali metal chlorite solution in a single pass mode, i.e., with no recirculation of the anolyte, using a porous, high surface area anode. The product solution, in addition to chlorine dioxide, may also contain unconverted chlorite as well as undesired by-products resulting from inefficiencies, such as chlorate ions or chlorine.

An improved single pass operation is disclosed in U.S. Pat. No. 6,203,688 in which the chlorite containing feed solution is pre-acidified prior to its entering the anode compartment of the electrochemical cell.

While the overall performance parameters, i.e., chemical efficiency and product purity, of the above described single pass processes for the electro-oxidation of chlorite ion to chlorine dioxide are generally satisfactory, the complexity of the divided electrochemical cell creates serious operational problems, such as membrane failure and/or anolyte by-pass, as well as negatively affecting the process economics. High sensitivity of the cation-exchange membranes towards certain impurities, primarily hardness, imposes additional requirements on the feed purity, thus further increasing the overall cost of the chlorine dioxide production by the single-pass process.

Recently, after the priority date of this application, U.S. Pat. No. 6,306,281 was issued, describing the concept of chlorine dioxide generation in an undivided electrochemical cell. According to this patent, chlorite conversions of up to 90% can be achieved in a single pass when operating an undivided electrochemical cell with buffered electrolyte having a pH below 10 and preferably in the pH range 8 to 9. Such conversions are considered to be unsatisfactory in commercial operations.

Commercially-acceptable conversion values are typically well above 90% and preferably close to 100%, corresponding to a complete utilization of the reactant. The cost of the reactant sodium chlorite constitutes the main cost of the entire operation.

There is a need, therefore, to develop a electrolytic chlorine dioxide generation process based on a single pass mode with no recirculation of the anolyte wherein the electrochemical cell does not exhibit the above-described deficiencies of the electrolysers known in the art.

SUMMARY OF THE INVENTION

Surprisingly, it has been found that electro-oxidation of chlorite ions to chlorine dioxide can be carried out with satisfactory efficiency and with conversions of close to 100% in an undivided electrochemical cell. This finding is completely unexpected, since it was always assumed in the prior art that the presence of a separator in the electrochemical cell is absolutely necessary in order to prevent the occurrence of the decomposition of the product of the anodic reaction, i.e., chlorine dioxide, at the cathode and to ensure the substantially complete utilization of the chlorite reactant.

It is well known that, under cathodic conditions, chlorine dioxide readily undergoes reduction to chlorite ions:

$$ClO_2 + e^- \Longrightarrow ClO_2^- \quad [2]$$

which is a reverse reaction to that occurring at the anode (reaction [1]). In addition, it was always assumed that the presence of a separator in the electrochemical cell is beneficial, since it enables the possibility to co-generate sodium hydroxide in the cathodic compartment of a divided cell, thus making the process particularly useful for applications utilizing both $ClO_2$ and NaOH, for example, pulp bleaching. Moreover, it was assumed in the prior art that, in the absence of a separator, the products generated at the anode ($ClO_2$) and the cathode (NaOH) would interact with each other according to the following reaction:

$$2ClO_2+2NaOH \Longrightarrow NaClO_3+NaClO_2+H_2O \quad [3]$$

resulting in a significant $ClO_2$ yield loss as well as the formation of a highly undesired by-product, sodium chlorate ($NaClO_3$).

According to the present invention, it was found that the lack of a physical barrier separating the cathodic and anodic compartments of an electrochemical cell does not necessarily preclude the possibility of achieving an effective conversion of chlorite ions to chlorine dioxide and that chlorine dioxide can be produced in a single pass in an undivided electrochemical cell.

Accordingly, in one aspect of the present invention, there is provided a process for the oxidation of chlorite ions to chlorine dioxide in an undivided electrochemical cell operated in single pass, comprising:

(1) passing an aqueous alkali metal chlorite solution through a high surface area anode structure into the interelectrode gap zone between the anode and a cathode;

(2) passing water or an aqueous acidic solution along the cathode structure within the interelectrode zone;

(3) applying sufficient electric current between the anode and the cathode in order to oxidize substantially all the chlorite ions in said aqueous alkali metal chlorite solution to chlorine dioxide;

(4) withdrawing an aqueous solution of chlorine dioxide from the electrochemical cell, optionally into a water stream.

GENERAL DESCRIPTION OF INVENTION

In one particular preferred embodiment of the present invention, the undivided electrochemical cell consists of two concentric cylindrical electrodes. An inner high surface area anode consists of a perforated metallic cylinder, generally made from platinized titanium, capped at the top, and covered with a layer of a high surface area electroconductive material, such as platinized titanium wool, sold by Olin Corporation under the Trademark TySAR$^R$, carbon cloth, graphite felt, etc.

The presence of a high-surface area anode material is essential to the invention in order to achieve commercially-acceptable conversions of the chlorite ions to chlorine dioxide. Lack of a high surface area anode results in unsatisfactory conversions in undivided electrochemical cells as is illustrated by the examples of aforementioned U.S. Pat. No. 6,306,281. The latter patent does not contemplate the utilization of such high surface area anode materials.

A cylindrical cathode, made generally from any suitable electrically-conductive metal or alloy, for example, titanium, encircles the high surface area anode leaving a nominal interelectrode gap, generally from about 1 to about 3 mm.

Figure 1:
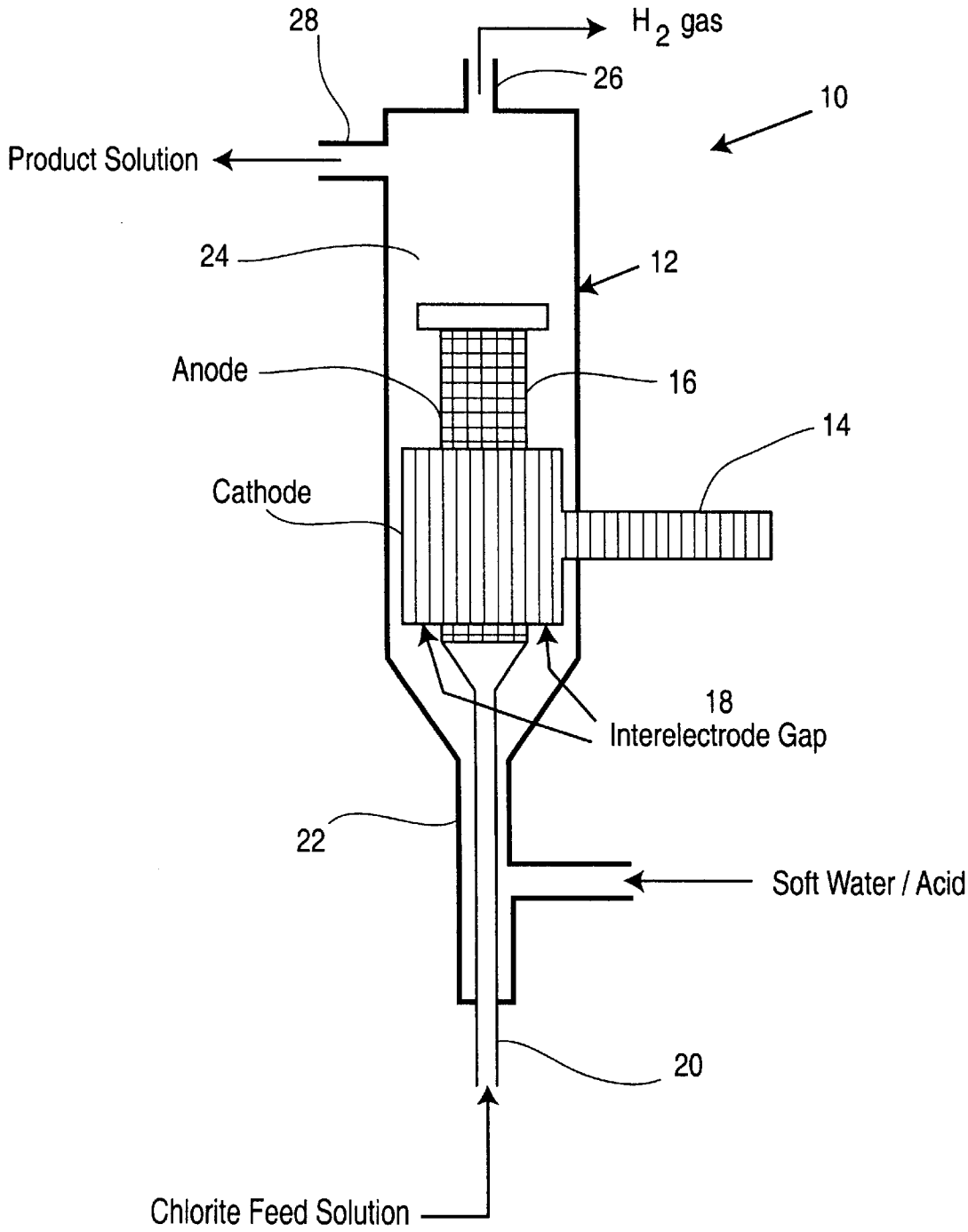
FIG. 1 is a schematic view of one embodiment of a design of an individual electrochemical cell for use in the present invention.

A dilute aqueous alkali metal chlorite solution, preferably sodium chlorite, generally having a chlorite ion concentration in the range of about 1 to about 20 gram per liter, optionally blended with an additional electrolyte, for example, alkali metal chloride, sulfate, phosphate, bicarbonate, etc., preferably the sodium salt, is fed to the bottom of the vertically placed anode cylinder and exits through the high surface area anode material into the interelectrode gap zone. Water, preferably having pH in the moderately acidic pH range, generally from about 2 to about 7, preferably from about 2 to less than about 5, and most preferably from about 2 to less than about 3.5, is fed into the bottom of the cell and flows upwardly into the interelectrode gap zone, functioning as the catholyte and also diluting the electrolyzed chlorite solution (product solution) to form an aqueous chlorine dioxide solution. The aqueous product solution is withdrawn from the electrochemical cell, optionally being diluted with more water and then directed to the point of use. A schematic of the cell in which this preferred embodiment is effected, is shown in FIG. 1.

In order to minimize the occurrence of the undesired reaction [3], it is beneficial to decrease the residence time of chlorine dioxide containing product solution in the enhanced alkalinity zone located in the proximity of the cathode. This objective can be attained by optimizing the flow rates of both the anolyte feed solution and catholyte water. Sufficient dilution of the hydroxyl ions formed at the cathode is believed to play an important role in the minimization of the occurrence of reaction [3] in the process of the invention. It is also believed that a much smaller surface area of the cathode as compared to the anode is beneficial in terms of minimization of the occurrence of the highly undesired cathodic reduction of chlorine dioxide to chlorite (reaction [2]). A smaller size cathode results in cathodic current density enhancement, which in turn favors the occurrence of the water decomposition reaction [4]:

$$2H_2O+2e^- \Longrightarrow H_2+2OH^- \quad [4]$$

rather than the above mentioned undesired reaction [2].

In order to minimize the occurrence of the undesired reaction [3] (i.e., the alkaline hydrolysis of chlorine dioxide), it is beneficial to lower the pH of the water being fed to the electrochemical cell. Such a pH adjustment may effectively prevent the formation of an alkaline zone in the proximity of the cathode by neutralizing the hydroxyl ions generated at that electrode. The pH adjustment can be effected by the addition of acid to the catholyte water stream or, alternatively, by creating a separate acid addition point to the cell. It is not recommended to add acid to the aqueous chlorite solution prior to passing said solution through an electrolytic cell as described in U.S. Pat. No. 6,306,281.

Any suitable acid, for example, hydrochloric acid, sulfuric acid, phosphoric acid, nitric acid, etc., or acid salt, for example, alkali metal bisulfate, bicarbonate, dihydrogenphosphate, etc., preferably the sodium salts, can be employed for the acidity adjustment. Alternatively, any suitable buffer can be used in order to maintain the pH within the interelectrode gap zone in the general range of from about 2 to about 7, preferably from about 2 to less than about 5, and most preferably about 2 to less than about 3.5, as described above. Commercially-acceptable conversions of well above about 90%, and preferably close to 100%, in terms of chlorite ions to chlorine dioxide, can only be achieved in the case when the electrolyte's pH is in the preferred range of above about 2 and less than about 5. The preferred pH range of 8 to 9 stated in U.S. Pat. No. 6,306,281 precludes the possibility of achieving such high conversion values.

The composition of the chlorite feed solution is believed to play an important role in the optimization of the overall process. Particularly beneficial appears to be the presence of certain additives, for example, alkali metal chloride or alkali metal sulfate, preferably the sodium salts. Such additives may enhance the conductivity of the feed solution, thus improving the current/potential distribution within the electrochemical cell. Furthermore, it is believed that the additives, such as chloride ions, may, in fact, actively participate in the chlorine dioxide generation, according to the following reaction sequence:

$$\text{Anode: } 2Cl^- \Longrightarrow Cl_2 + 2e^- \quad [5a]$$

$$\text{Solution: } Cl_2 + 2ClO_2^- \Longrightarrow 2ClO_2 + 2Cl^- \quad [5b]$$

$$\text{Overall: } 2ClO_2^- \Longrightarrow 2ClO_2 + 2e^- \quad [5c]=[1]$$

The presence of chloride ions in the anolyte feed solution at the general level of from about 1 to about 20 grams per liter may, therefore, lead to an improvement in the conversion of chlorite ions to chlorine dioxide. Since the occurrence of the reaction [5b] between chlorite ions and the chlorine intermediate is believed to be favored by higher concentrations of both reactants, its contribution to the overall process is expected to be higher at lower dilutions. However, the minimization of the dilution effect has to be balanced against the benefits of lower hydroxyl ion concentrations in the interelectrode gap zone, associated with higher dilutions.

A wide variety of electrochemical cell designs can be employed in the process of the invention. Possible electrolysers can be of the so-called filter-press, plate-and-frame type or, preferably, those utilizing the co-axial, annular design. Examples of such undivided, electrochemical cells are shown in FIGS. 1, 2, 3 and 4. The preferred cell design is depicted in FIG. 1.

DESCRIPTION OF PREFERRED EMBODIMENT

Referring to the drawings, FIG. 1 shows a preferred design of electrochemical cell 10 comprising an upright cylindrical housing 12 having concentrically arranged anode and cathode elements 14 and 16 defining an interelectrode gap 18. The cathode cylinder 14 encircles the anode 16 and is constructed of titanium or other suitable conductive metal or alloy. The anode 16 consists of a perforated platinized titanium cylinder, closed at the upper end, covered with a layer of platinized titanium wool or other high surface area electroconductive material.

Aqueous sodium chlorite feed solution is fed by an inner pipe 20 to the lower end of the cylindrical anode 16 for electrochemical oxidation of chlorite ions to chlorine dioxide, the products of such anodic reaction passing through the high surface area anode into the interelectrode gap. Acidified water is fed via an outer annular feed pipe 22 to the lower end of the interelectrode gap 18 and to flow over both surfaces of the electrode. The products of electrolytsis exiting the upper end of the interelectrode gap are separated from cathodically-produced hydrogen in an upper region 24 of the housing 12. The hydrogen gas is vented by line 26 while product solution, comprising aqueous chlorine dioxide solution, is removed by line 28.

Figure 2:
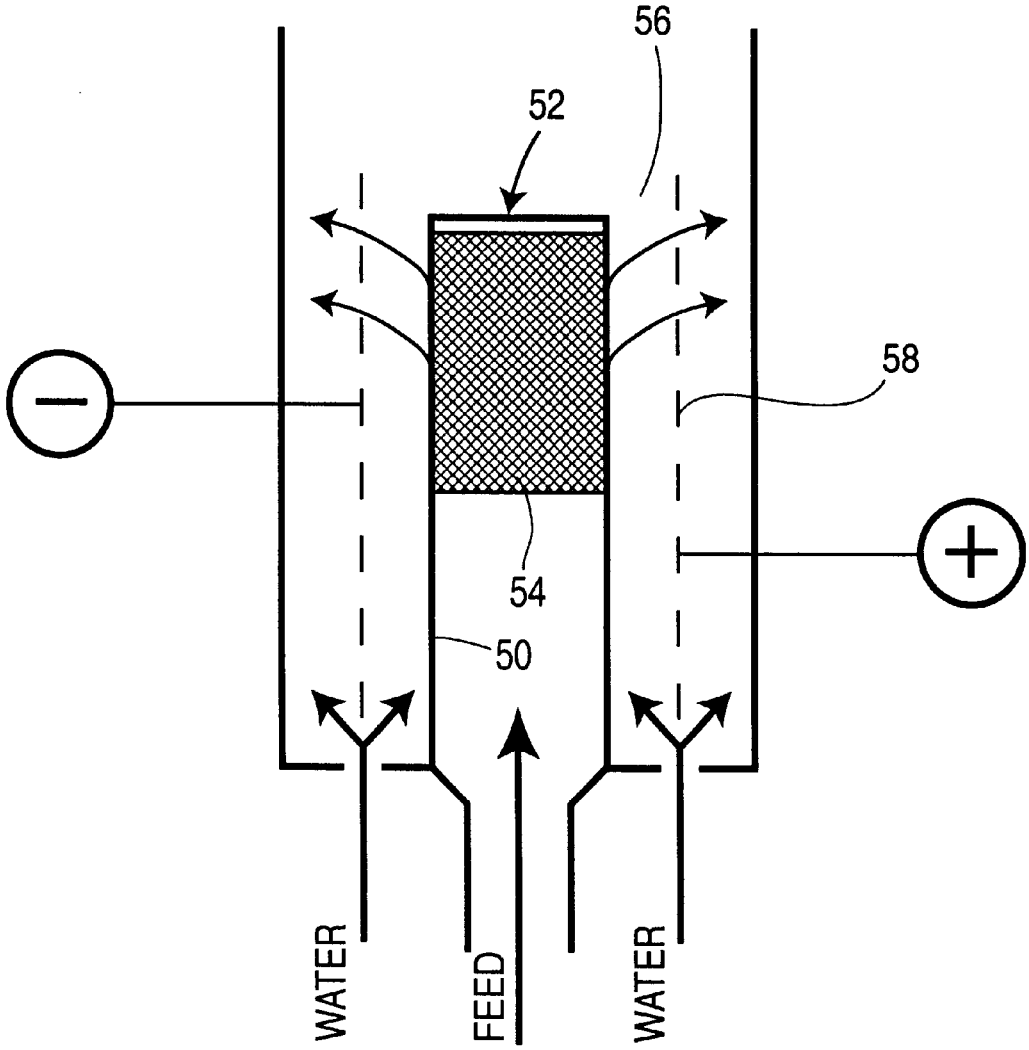
FIG. 2 is a schematic view of a further embodiment of a design of an individual electrochemical cell for use in the present invention.
Figure 3:
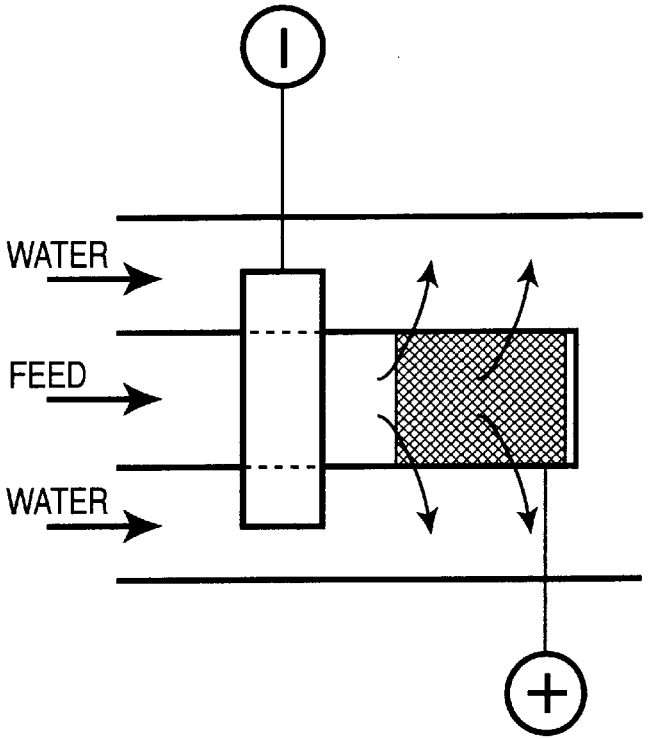
FIG. 3 is a schematic view of an additional embodiment of a design of an individual electrochemical cell for use in the present invention.

FIGS. 2 and 3 show two alternative designs for annular reactors. In FIG. 2, a feed of aqueous sodium chlorite is fed into the lower end of an inner pipe 50 sealed at the upper end 52. The upper portion of the perforated pipe is covered with a high surface area anode material 54. The aqueous sodium chlorite is oxidized at the anode, forming chlorine dioxide, and flows through the high surface area anode material 54 into the annular space 56 between the anode 50 and the cylindrical cathode 58, in the form of a perforated coaxial cylinder. Both the inner and outer surfaces of the cathode 58 are swept by high flow dilution water fed to the lower end of the cathode.

The arrangement in FIG. 3 is similar to that of FIG. 1. As in FIG. 1, the aqueous sodium chlorite feed flows through an inner pipe, the upper end of which is covered with a high surface area anode material. Conversion of sodium chlorite to chlorine dioxide occurs at the anode and the solution is discharged through the perforations into a stream of dilution water. The cathode is a coaxial cylinder of electroconductive material.

Figure 4:
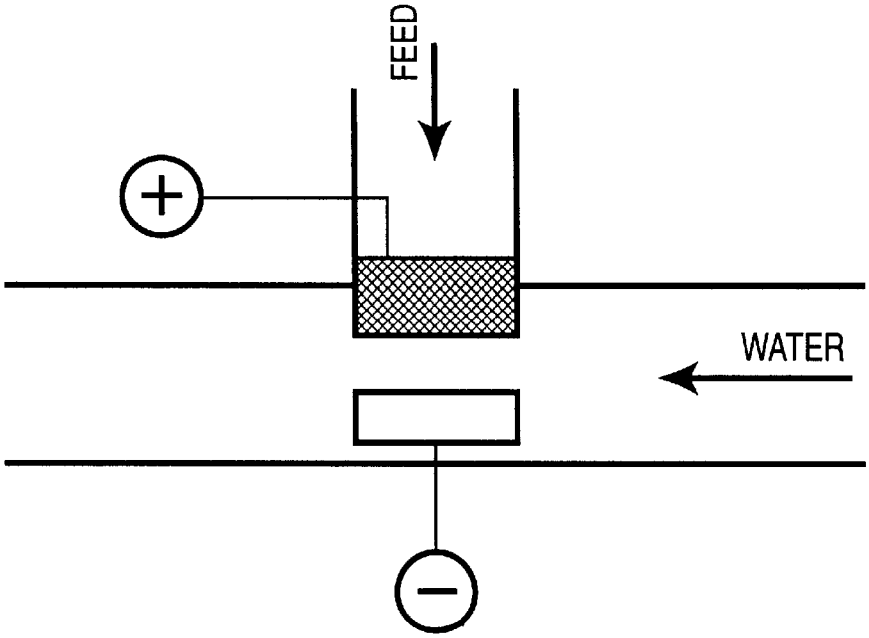
FIG. 4 is a schematic view of a yet further embodiment of a design of an individual electrochemical cell for use in the present invention.

FIG. 4 shows a injector type of electrolyser. In this arrangement, the aqueous feed of aqueous sodium chlorite is injected through the high surface area anode directly into a flowing stream of dilution water, with the cathode positioned in the flowing stream adjacent to the anode.

EXAMPLE

This Example illustrates the process of the invention.

The electrochemical cell employed in this Example consisted of two concentric electrodes as depicted in FIG. 1. The cathode encircled the anode leaving a nominal 1 mm gap. The cathode was made from a thick, solid titanium cylinder with low surface area. The high surface area anode consisted of a perforated platinized titanium cylinder, capped at the top, and covered by a thin layer of platinized titanium wool commercially sold as TySAR WP-12 by Olin Corporation (the superficial surface area of the anode was approximately 120 $cm^2$).

Formulated sodium chlorite solution containing 9.5 g/L sodium chlorite and 9.9 g/L sodium chloride, having pH of about 11.1, was fed at a rate of 10.8 mL/min into the anode cylinder and exited through the TySAR into the gap between the electrodes. Soft water having pH of 2.19 was fed at a rate of 0.5 L/min into the bottom of the cell and was flowed upwardly into the interelectrode gap. The current applied to the cell was 6 A, corresponding to the superficial anodic current density of 0.5 $kA/m^2$. The cell voltage was 6.2 V. Chlorite was oxidized to $ClO_2$ at the anode while water was reduced to hydrogen gas and the hydroxyl ion at the cathode. The exiting product solution had pH of about 2.5 and contained 113.1 ppm chlorine dioxide and only 0.5 ppm of unreacted sodium chlorite which corresponds to a substantially complete conversion of the sodium chlorite reactant to chlorine dioxide (conversion better than 99.9%). The efficiency calculated based on the chlorite input and chlorine dioxide output was 72.1%. The chlorine dioxide product solution was 99.8% pure (containing less than 0.2 ppm chlorine).

In a comparative example involving the use of water having a pH of 7.1 the conversion was only 74%, while the efficiency was 50%.

In summary, the overall performance of the novel generator of the present invention was significantly better than that of the generator described in the earlier mentioned U.S. Pat. No. 6,306,281. It is believed that the superior performance of the presently described generator can be attributed primarily to the lower pH range employed, a different anode design (high surface area three-dimensional anode in the presently described generator vs. conventional, two-dimensional anode, made preferably from a dimensionally stable material or lead oxide stabilized graphite in a generator described in the latter patent), and a different reactant addition mode.

SUMMARY OF THE DISCLOSURE

In summary of this disclosure, the present invention provides a method of generating chlorine dioxide from alkali metal chlorite by electrochemical oxidation of chlorite ions in a single pass in an undivided electrochemical cell. Modifications are possible within the scope of the invention.

What we claim is:

1. A process for the oxidation of chlorite ions to chlorine dioxide in an undivided electrochemical cell operated in a single pass, which comprises:

passing an aqueous alkali metal chlorite solution through a high surface area anode structure into an interelectrode gap zone between said anode and a cathode, passing water or an aqueous acidic medium solution along the cathode within the interelectrode zone, applying sufficient electric current between the anode and the cathode in order to oxidize substantially all the chlorite ions in said aqueous alkali metal chlorite solution to chlorine dioxide, and withdrawing an aqueous solution of chlorine dioxide from the electrochemical cell.

2. The process of claim 1 wherein said undivided electrochemical cell comprises two concentric cylindrical electrodes with an inner high surface area anode comprising a perforated metal cylinder capped at the upper extremity and covered with a layer of high surface area material and an outer cylindrical cathode spaced from the anode by the interelectrode gap zone.

3. The process of claim 2 wherein said perforated metal cylinder is constructed of platinized titanium and said high surface area material is selected from the group consisting of platinized titanium, carbon cloth and graphite felt.

4. The process of claim 2 wherein said interelectrode gap zone is sized from about 1 to about 3 mm.

5. The process of claim 2 wherein said aqueous alkali metal chlorite solution is an aqueous sodium chlorite solution having a concentration of about 1 to about 20 g/L, optionally blended with an additional electrolyte.

6. A process for the oxidation of chlorite ion to chlorine dioxide in an undivided electrochemical cell operated in a single pass, which comprises:

providing an undivided electrochemical cell comprising two concentrated cylindrical electrodes with an inner high surface area anode comprising a perforated metal cylinder capped at the upper extremity and covered with a layer of high surface area material and an outer cylindrical cathode spaced from the anode by an interelectrode gap zone, passing an aqueous sodium chlorite solution having a concentration of about 1 to about 20 g/L, optionally blended with an additional anolyte, to the lower end of a vertically-extending anode cylinder to pass upwardly therein and exit through the high surface area anode into the interelectrode gap zone, passing water to the lower end of the cell to flow upwardly into the interelectrode gap zone, and along the cathode within the interelectrode gap zone and to dilute the electrolyzed aqueous sodium chlorite solution and producing a product solution, applying sufficient electric current between the anode and the cathode in order to oxidize substantially all the chlorite ion in said aqueous sodium chlorate solution to chlorine dioxide, and withdrawing said product solution in the form of an aqueous solution of chlorine dioxide from the electrochemical cell.

7. The process of claim 6 wherein said product solution is diluted with water for direction to the point of use of the resulting aqueous chlorine dioxide solution.

8. The process of claim 6 wherein said water has a pH in the range of about 2 to about 7.

9. The process of claim 8 wherein said water has a pH in the range of about 2 to less than about 5.

10. The process of claim 8 wherein said water has a pH in the range of about 2 to less than about 3.5.

11. The process of claim 6 wherein a buffer is used to maintain the pH within the interelectrode gap zone in the range of about 2 to about 7.

12. The process of claim 11 wherein the pH within the interelectrode gap zone is maintained at about 2 to less than about 5.

13. The process of claim 11 wherein the pH within the interelectrode gap is maintained at about 2 to less than about 3.5.

14. The process of claim 6 wherein said aqueous sodium chlorite solution contains about 1 to about 20 g/L of sodium chloride.

* * * * *